United States Patent [19]

Thomas

[11] Patent Number: 4,660,239

[45] **Date of Patent: * Apr. 28, 1987**

[54] THERAPEUTIC PILLOW

[76] Inventor: Charles R. Thomas, 9696 Northlawn, Detroit, Mich. 48204

[ * ] Notice: The portion of the term of this patent subsequent to Apr. 30, 2002 has been disclaimed.

[21] Appl. No.: 853,261

[22] Filed: Apr. 17, 1986

[51] Int. Cl.[4] ..... A47C 20/02

[52] U.S. Cl. ..... 5/434; 5/436; 5/442

[58] Field of Search ..... 5/434–437, 5/442

[56] References Cited

U.S. PATENT DOCUMENTS

| | | | |
|---|---|---|---|
| 1,206,775 | 11/1916 | Everts | 5/442 |
| 2,805,428 | 9/1957 | Buchman | 5/442 |
| 3,061,844 | 11/1962 | Coursey | 5/436 |
| 3,443,267 | 5/1969 | Schuckman | 5/442 |
| 3,521,310 | 7/1970 | Greenawalt | 5/436 |
| 4,513,462 | 4/1985 | Thomas | 5/434 |

FOREIGN PATENT DOCUMENTS

| | | | |
|---|---|---|---|
| 26072 | of 1908 | United Kingdom | 5/437 |

*Primary Examiner*—Gary L. Smith
*Assistant Examiner*—Michael F. Trettel
*Attorney, Agent, or Firm*—Cullen, Sloman, Cantor, Grauer, Scott, & Rutherford

[57] ABSTRACT

A therapeutic pillow comprises a soft resilient bottom pillow section and a top pillow section thereover and peripherally interconnected. The top section includes top and bottom fabric covers peripherally interconnected with a pair of rows of stitching spaced from the ends of the pillow sections, and a transverse stitching between the rows of stitching interconnecting the covers defining a first tubular neck support of rectangular shape and a pair of laterally spaced supplemental neck supports of rectangular shape. Compacted resilient fiber stuffing is interposed within the neck supports. The bottom section includes a bottom fabric cover peripherally jointed to the top section containing a mass of loosely confined resilient fiber stuffing which underlies the top pillow section.

6 Claims, 5 Drawing Figures

FIG. 3
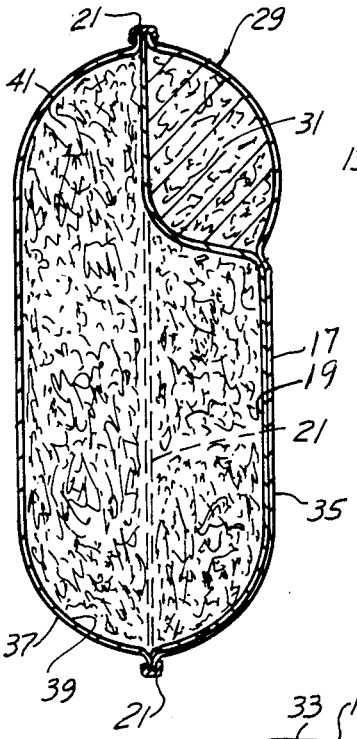
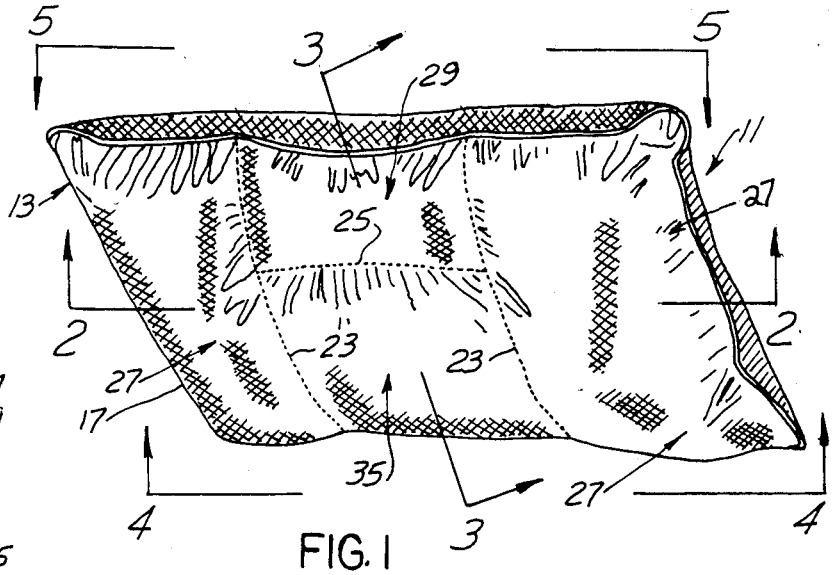
FIG. 1
FIG. 2
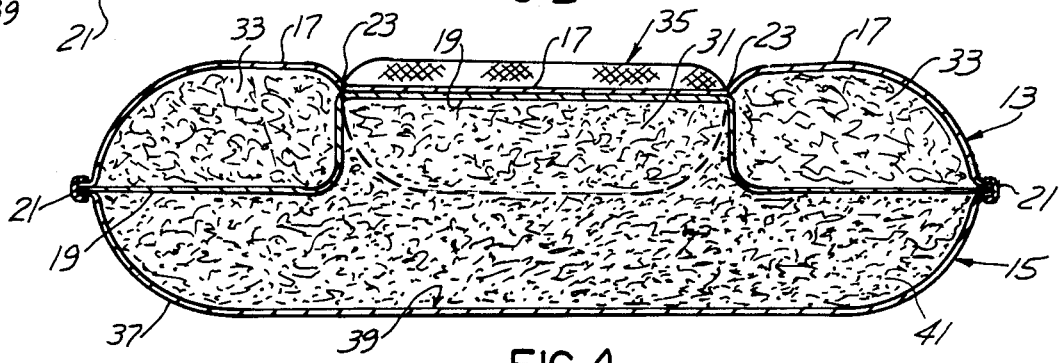
FIG. 4
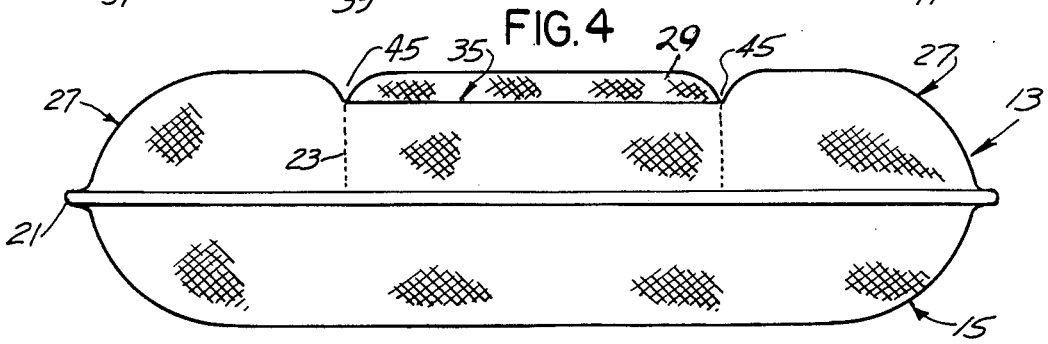
FIG. 5
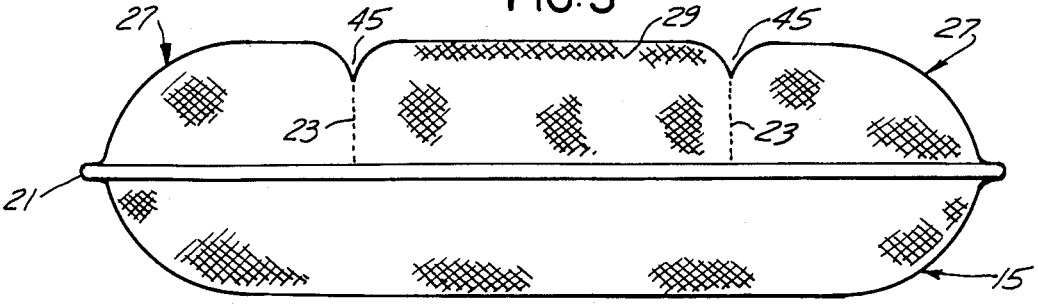

THERAPEUTIC PILLOW

BACKGROUND OF THE INVENTION

1. Field of Invention

The present invention is directed to pillows and more particularly a therapeutic pillow which has a soft and resilient central section and a peripheral firm neck support.

This is an improvement over Applicant's U.S. Pat. No. 4,513,462 of Apr. 30, 1985.

2. The Prior Art

Heretofore various efforts have been made to provide a pillow which provides a firm neck support and at the same time a soft yielding head support. Illustrations of such prior art are shown in one or more of the following United States Patents:

| U.S. Pat. No. | NAME | DATE |
|---|---|---|
| 35,947 | C. W. Meinecke | December 31, 1901 |
| 1,020,444 | S. L. Platt | March 19, 1912 |
| 3,400,413 | E. LaGrossa | September 10, 1968 |
| 3,521,310 | M. H. Greenawalt | July 21, 1970 |
| 3,667,074 | William M. Emery | June 6, 1972 |
| 3,829,917 | Earle W. DeLaittre | August 20, 1974 |
| 3,902,456 | Mildred M. David | September 2, 1975 |
| D238,104 | Samuel L. McNair | December 16, 1975 |
| 4,320,543 | Linda H. Dixon | March 23, 1982 |

The difficulties with the prior art pillow constructions were that some neck supports were provided with a hardened latex material with the head support of a soft resilient latex material. A plurality of different types of firm materials were provided to define a neck support as well as a head support including unit molded pillows having a central section to receive the head and with peripheral portions for supporting the neck. The contoured pillows in the prior art essentially were difficult to assemble. Pillow assemblies had a central opening for the head and peripheral portions to supportably receive the neck.

SUMMARY OF THE INVENTION

An important feature of the present invention is to provide a therapeutic pillow which has a resilient fluffy bottom pillow section and an upper pillow section and wherein peripheral tubular portions on three sides thereof are filled with a compacted resilient fibrous material to define a firm neck support.

Another feature is to provide a therapeutic pillow which consists of bottom and top sections with the top section having top and bottom fabric covers which are peripherally interconnected and which include additional stitching spaced inwardly of one side and both ends of the covers, which centrally interconnects the covers and which defines a first tubular firm neck support of rectangular shape and a pair of laterally spaced supplemental tubular neck supports. The neck supports are filled with snugly compacted resilient fiber.

Another feature includes a top pillow section overlying a bottom pillow section which includes a second bottom fabric cover spaced from the bottom fabric cover of the top section defining a chamber which underlies the top pillow section and within which is loosely confined resilient stuffing of a fibrous material completely underlying the top pillow section.

An important feature includes within the top section, a series of peripheral portions upon three sides which are of a tubular construction and within which compacted resilient stuffing is positioned and retained to define a firm neck support. The top section overlies and is peripherally secured to the bottom section which simulates the conventional soft resilient pillow. The bottom pillow section has only a bottom cover thereon, with a soft resilient stuffing of a fibrous material positioned within the bottom section underlying and in engagement with undersurface portions of the bottom cover of the top pillow section.

An important feature further includes a centrally disposed resilient and soft head support which extends to one side of the pillow and is in direct overlying engagement with the soft resilient bottom section section of the therapeutic pillow.

These and other features and objects will be seen from the following specification and claims in conjunction with the appended drawings.

THE DRAWINGS

FIG. 1 is a front perspective view of the present therapeutic pillow.

FIG. 2 is a section taken in the direction of arrows 2—2 of FIG. 1 on an increased scale.

FIG. 3 is a similar section taken in the direction of arrows 3—3 of FIG. 1.

FIG. 4 is a side view taken in the direction of arrows 4—4 of FIG. 1 on an increased scale.

FIG. 5 is a similar view taken in the direction of arrows 5—5 of FIG. 1.

It will be understood that the above drawing illustrates merely a preferred embodiment of the invention and that other embodiments are contemplated within the scope of the claims hereafter set forth.

DETAILED DESCRIPTION OF AN EMBODIMENT OF THE INVENTION

Referring to the drawing, the present therapeutic pillow 11, FIG. 1, includes top pillow section 13 and bottom pillow section 15 peripherally interconnected as shown in FIG. 2. The top pillow snugly overlies the bottom pillow section.

The top pillow section includes top fabric cover 17 of a suitable material which may be plain, ornamented as desired or have an attractive design and a plain bottom fabric cover 19. Covers 17 and 19 are interconnected by the peripheral stitching and bead 21, FIGS. 2 and 3.

Inner spaced rows of stitching 23 are spaced inwardly of the corresponding ends of the assembled pillow sections and interconnects cover 17 and first bottom cover 19, FIGS. 1 and 2, with portions of the covers upon the interior of the stitching being in surface engagement.

Transverse stitching 25 extends between stitching rows 23 and is spaced inwardly from one side of the pillow. The first peripheral stitching 21, the stitching 23 and the transverse stitching 25 define within the top pillow section and between the covers 17 and 19, the elongated rectangular tube 29. Said tube is exteriorly and transversely convex, defining a firm neck support 29, FIG. 3. Compacted resilient fiber 31, such as a polyester fiber, cotton, down or feathers is snugly nested and retained within neck support 29, sometimes referred to as the first neck support.

At opposite ends of neck support 29 are a pair of opposed tubes 27 defined by peripheral stitching 21 and stitching 23. Confined within tubes 21 is similarly compacted fiber 33, such as polyester fiber, for illustration. In the illustrative embodiment, the compacted fiber 33 within the supplemental neck supports 27 may be similarly or less compaced, but nevertheless provides a firm neck support.

The area of the top pillow section within stitching 23 and 25 to one side of the pillow opposite support 29 defines with the bottom pillow section 15, a soft resilient headrest 35.

The bottom pillow section 15 includes a single fabric second bottom cover 37 which generally underlies and is spaced from the bottom fabric cover 19 to define rectangular chamber 39. The second bottom cover 37 is peripherally connected to the top pillow section 13 by peripheral stitching and bead 21, FIGS. 2 and 3.

A stuffing 41 of a non-compacted fiber, such as polyester fiber, cotton, down or feather is confined and loosely retained within chamber 39 so as to completely underlie the top pillow section 13. The bottom fabric cover 19 for the top pillow section provides the cover for the bottom pillow section 15 within which is loosely confined the polyester resilient fibrous filling 41.

The therapeutic pillow 11 includes a top pillow section 13 within which there are provided firm compacted neck support sections 29, 27 with the neck support sections overlying and supported upon the soft fluffy bottom pillow section 15. This provides a soft resilient support for the top pillow section.

Since there is no stuffing between fabric covers 17 and 19 within the central area between neck supports 27, a headrest 35 defined, which overlies portions of the loosely confined polyester fiber or other resilient fibrous filing 41 to provide a soft comfortable headrest.

The rows of stitchings 23 provide in the top pillow section the pair of laterally spaced parallel indentations 45, FIGS. 2, 4 and 5.

Said indentations define the primary yieldable but firm tubular neck support 29 for the user when inclined in a horizontal position, with the users neck resting upon the firm tubular support 29 or alternately either of the tubular supports 27. The users head rests upon the central and soft portions of the underlying bottom pillow section.

While stitching has been shown at 21, 23 and 25, it is contemplated that stitching could be replaced by some other form of securing by which the adjacent portions are interconnected. The peripheral side portions of cover 37 of bottom section 15 are connected to peripheral undersurface portions of the top pillow section by the continuous peripheral stitching and bead 21.

As desired the bottom cover 37 for the bottom pillow section 15 may be ornamented similarly to the top cover 17 or made of a plain cotton or other material.

Having described my invention, reference should now be had to the following claims:

I claim:

1. A therapeutic pillow of rectangular shape having spaced ends and sides comprising a soft resilient bottom pillow section;

a top pillow section superimposed thereover and peripherally secured thereto;

the top section including a top fabric cover and an underlying first bottom fabric cover with said covers peripherally interconnected;

a pair of laterally spaced rows of continuous stitching spaced inwardly of said ends and the corresponding peripheral connections of said covers;

additional stitching extending between and transversely of said rows of stitching spaced inwardly of the corresponding connection of said covers upon one side thereof, defining with said rows of stitching a first tubular firm neck support of rectangular shape, exteriorly and transversely convex;

said rows of stitching defining with the adjacent end connection of said covers a pair of laterally spaced supplemental tubular firm neck supports of rectangular shape exteriorly and transversely convex, at opposite ends of said first neck support;

first compacted stuffing of resilient fibrous material confined and retained within said first neck support;

second compacted stuffing of resilient fibrous material confined and retained within said pair of supplemental neck supports;

said bottom section including a second bottom fabric cover generally spaced from and parallel to said first bottom cover and peripherally connected thereto defining a rectangular chamber underlying said top pillow section;

and a loosely confined stuffing of resilient fibrous material enclosed and retained within said chamber yieldably underlying said top pillow section.

2. In the therapeutic pillow of claim 1, said top and first bottom fabric covers between said rows of stitching and outwardly of said additional stitching away from said first neck support being in surface engagement and overyling the bottom pillow section and the stuffing therein defining a soft resilient headrest between said supplemental neck supports.

3. In the therapeutic pillow of claim 1, the peripheral connections between said top and bottom fabric covers and the second bottom cover being a single continuous stitching.

4. In the therapeutic pillow of claim 1, the height of said neck support and supplemental neck supports being substantially uniform.

5. In the therapeutic pillow of claim 1, said peripheral stitching being substantially midway of the overall height of said top and bottom pillow sections.

6. In the therapeutic pillow of claim 1, said resilient stuffing being selected from the group consisting of polyester fiber, cotton, down and feathers.

* * * * *